US005318401A

United States Patent [19]

Mandel

[11] Patent Number: 5,318,401

[45] Date of Patent: Jun. 7, 1994

[54] STACKING TRAY SYSTEM WITH NONVERTICALLY RECEDING ELEVATOR YIELDING SQUARE STACKS

[75] Inventor: Barry P. Mandel, Fairport, N.Y.

[73] Assignee: Xerox Corporation, Stamford, Conn.

[21] Appl. No.: 888,066

[22] Filed: May 26, 1992

[51] Int. Cl.[5] ..... B65G 57/22

[52] U.S. Cl. ..... 414/792.7; 414/924; 271/213; 271/214; 271/217

[58] Field of Search ..... 414/924, 926, 794.8, 414/792.7; 271/213, 214, 215, 217, 207, 224

[56] References Cited

U.S. PATENT DOCUMENTS

| | | | |
|---|---|---|---|
| 2,933,314 | 4/1960 | Stobb | 271/215 |
| 4,541,763 | 9/1985 | Chandhoke et al. | 414/924 X |
| 4,577,853 | 3/1986 | Duke | 271/217 |
| 4,718,807 | 1/1988 | Baxter | 414/794.8 X |
| 4,880,350 | 11/1989 | Stobb | 414/924 X |
| 5,026,034 | 6/1991 | Russel et al. | 270/52 |
| 5,098,074 | 3/1992 | Mandel et al. | 270/53 |
| 5,190,281 | 3/1993 | Cardenas | 271/217 X |

*Primary Examiner*—Cheryl L. Gastineau

[57] ABSTRACT

A sheet stacking system for stacking the sequential sheet output of a reproducing apparatus, with a sheet stacking tray providing an upwardly inclined sheet stacking surface at a substantial angle above the horizontal for receiving and registering sheets to be stacked thereon from a sheet output against an edge registration surface, and with a tray elevator for linearly repositioning the sheet stacking tray relative to the sheet output for maintaining the top stacking position and inclination, for the accumulation of a large stack; wherein the tray elevator repositions the sheet stacking tray downwardly in a linear but non-vertical movement path which is more perpendicular to the angle of the inclined sheet stacking surface and parallel to the edge registration surface, to provide non-vertical but more squarely superposed sheet stacking in the sheet stacking tray. Preferably, the sheet stacking apparatus has a non-vertical fixed end wall parallel the non-vertical movement direction of the sheet stacking tray, and this end wall provides the edge registration surface.

1 Claim, 4 Drawing Sheets

STACKING TRAY SYSTEM WITH NONVERTICALLY RECEDING ELEVATOR YIELDING SQUARE STACKS

The disclosed system provides improved sequential output stacking of multiple sheets, such as multiple sets of copy sheets outputted by a copier or printer, with improved overall stack alignment for subsequent handling, particularly for large stacks, with little or no increase in cost, and without sacrificing desired initial inclined stacking and registration orientations, by providing a non-vertical stacking system.

As is well known in the art, and further discussed hereinbelow, it is often desirable to sequentially stack output sheets at an angle to the horizontal, i.e., to deposit the outputted sheets onto an inclined surface, (initially the inclined sheet stacking surface of the tray, and then the corresponding inclined upper surface of sheets previously stacked thereon) for better stacking registration. This is known in the art as "uphill" stacking if the stacking surface is upwardly inclined. There are many advantages to using either "uphill" or "downhill" stacking, per se, and/or for compiling and stapling. It allows different sizes of sheets to be compiled and stacked with the same fixed paper path and the same tray system, using gravity assisted stacking against a simple inboard or registration wall or surface, and therefore, is relatively less expensive than more complicated stacking registration/alignment systems, such as those requiring scuffers, flappers, tampers, joggers, etc. "Uphill" stacking lends itself to stacking at an outboard end of a machine and/or in a modular end unit.

However, a disadvantage of such inclined tray stacking is that, as is further discussed herein, the accumulated stacks in the stacking tray may be skewed or sloped to one another after removal from the stacking tray (as illustrated in FIG. 3) if the registration wall is not maintained perpendicular the stacking surface. In the past, this has led to recommendations to limiting the stacking tray stacking angle to approximately 35° to minimize this problem. If a compiler area for a finisher is located above the stacking tray, as shown in the below-cited U.S. Pat. No. 5,098,074 by the same author, this may introduce an even further practical limitation. It may make an even steeper compiler angle desirable in some cases.

The disclosed sheet output stacking system has particular utility or application for improved stacking of pre-collated copy output sheet sets from a copier or printer into an output stacker (which may encompass finisher compilers), such as in stacking large numbers of completed copy sets in a high-capacity stacker, especially, a moving tray stacker (a tray repositioning, resetting or tray elevator stacker). Such stacked copy sets may be unfinished, or may be stapled, glued, bound, or otherwise finished and/or offset.

High-capacity stackers are particularly desirable for the collected output of high speed or plural job batching copiers or printers. High capacity stackers (with job offsetting) are also desirable for accumulated output of unattended plural user (networked) printers, of any speed, or plural document job set "batching" stackers.

It is well known in the art to be desirable to provide a stacking system with a stack elevator (see art cited below and FIG. 2), so that the stacking tray is maintained at said suitable angle for such initial stacking, but so that the stacking tray is moved downwardly vertically as the stack accumulates, so that the top of the stack remains in the same general relative position below the sheet output. However, FIG. 3 illustrates that when a large accumulated stack in a prior art inclined stacking tray with a vertically moving stacking elevator of FIG. 2 is removed and placed on a normal horizontal surface, that this stack is not square, i.e., it is skewed, in that it is not properly vertically aligned or fully superposed. Two of the stack end surfaces are not squared (not perpendicular to the plane of the stacked sheets). In fact, such a non-squared set could even fall over. Such a non-aligned set must be manually realigned, with difficulty, in order to even fit into a standard sized container for standard sized sheets of paper.

Note that in the prior art vertically moving stack elevator system illustrated here in FIG. 2, and in the cited art, the stacking elevator movement is vertically along the vertical side of the processor or machine, (the vertical side of the stacking module in the case of an add-on modular unit). Since the stacking tray must move down for substantial distance to accumulate the stacking of a substantial set, the stacking registration wall is normally that same fixed vertical surface and not an integral upstanding end of the tray itself, as in a sorter bin or other conventional stacking tray. That is, the registration surface against which the incoming copy sheets are registered is the vertical surface of the end of the machine or the stacking tray elevator itself. If, instead, a conventional registration end wall integral (and perpendicular to) the stacking tray were providing (moving therewith), that registration wall would have to have a height equal to the full elevator travel range of the stacking tray, as otherwise, sheets stacked higher than that registration wall would slide off the stack. In the empty (fully raised) position of such a stacking tray, such a high registration end wall would unacceptably extend way above the top of the machine.

Thus, this illustrated prior art, moving tray, high-capacity, output stacker of FIG. 2 here (and FIG. 3E of U.S. Pat. No. 5,098,074, cited infra, etc.), does not have a stacking registration wall at an angle which is normal (90° to) the stacking tray surface. These two surfaces are at an acute angle to one another.

As noted, this causes this prior art stack of stacked sheets to be skewed or slanted. That is, the topmost sheets of the accumulated stack are significantly displaced laterally from the bottom-most sheets of the stack when the stack is removed and placed on a horizontal surface, as shown in FIG. 3.

In contrast, the present stacking system can provide a registration wall for stacking registration of incoming sheets which is perpendicular to the surface of the stacking tray, to provide unskewed or "squared" stacking, even where the stacking tray is an elevator repositioning type.

In the present system, a non-vertical or angled registration stacking wall can be provided which is desirably perpendicular the stacking surface and the corresponding underlying stacking surface.

The system disclosed herein overcomes the above and other problems without sacrificing the desired initial stacking angle of the stacking surface for the outputted sheets. It overcomes the problem by teaching a particular preset linear movement direction of the repositioning stacking tray elevator at an angle to the vertical and/or by maintaining a stacking registration surface perpendicular to the stacking surface.

In the disclosed system, the stack registration wall and the stacker elevator movement direction may both be at approximately 90° to the stacking surface (and thus, parallel one another), but both are at the same non-vertical angle to the rest of the system, rather than vertical as previously.

The specific exemplary embodiment disclosed hereinbelow discloses a stacking tray with an inclined stacking surface at a desired stacking angle to the horizontal. The stacking tray here has a sheet stacking registration wall at the lower end of the stacking surface which is perpendicular to (at 90° to), the stacking surface. This stacking tray comprises an integral tray unit movably mounted on a tray elevator track and movable by a tray elevator system to maintain said orientation. The tray elevator system here is uniquely able to move downwardly but also outwardly, in a linear path which is at a minor angle from the vertical. This non-vertical elevator track angle here is at the same angle as the stacking registration wall, which allows the fixed elevator and wall to provide the stacking. This elevator track angle is also equal to the angle that the tray surface is inclined from the horizontal to provide "uphill stacking". Thus, desirable initial output stacking and registration of copy sheets is provided a desired angle providing an inclined or sloping surface for edge registration assistance by gravity encouraging the sheets to slide down on top of the inclined stack down against the registration wall. That stacking slope is preferably inclined downwardly back towards the sheet output, to provide "uphill" stacking, but "downhill" stacking is also shown in one example in FIG. 4, and in another example in FIG. 5.

In the disclosed system, such a desirable initial stacking angle is compatibly combined with correctly, fully aligned, set stacking relative to all previously stacked sets by a compatible non-vertical movement of the stacking tray for cumulative stacking. All sheets of the completed or removed stack are evenly aligned and superposed with one another with the present system.

Some examples of prior patents disclosing high-capacity stackers include Xerox Corporation U.S. Pat. No. 5,098,074, issued Mar. 24, 1992 to the same Barry P. Mandel, et al., and Eastman Kodak Company U.S. Pat. No. 5,026,034, issued Jun. 25, 1992 to Steven M. Russel, et al., and art cited therein. An integral or modularly related copy set compiler and stapler or other finisher can be provided, as disclosed in said same U.S. Pat. No. 5,098,074 and art therein. A commercial high capacity Gradco Corp. "3000 sheet output stacker" has attempted to attack this problem of "stack lean" in a very different way. It uses a curved output tray with a stacking surface that is horizontal where it meets the registration wall and then curves upwardly. The paper stack is therefore square to the registration wall at the registration wall, but at that end of the stack only, so the rest of the stack still "leans". The stack is arcuately deformed, and the top of the stack is not flat or uniformly sloped. This system has several other apparent shortcomings. First, there is limited uphill or downhill stacking capability, since the slope of this tray is very low (in fact, horizontal) near the registration edge. This system cannot be effectively used to stack small sizes of sheets, since they would not readily slide back down on the top of the stack into registration. Secondly, if the operator grasps the stack for removal in its outer, skewed, portion (where tray hand-access cut-outs are usually located) the whole stack will be removed skewed—the registration end will also skew as the stack flexes upon removal while being so gripped. Thirdly, this prior system does not lend itself well to use with a single shared tray stapler/stacker (an integral compiler/-stacker of U.S. Pat. No. 5,098,074, above) since the curvature of the tray (concave upwards) is opposite of what is optimal to minimize staple build-up in multiple stapled set stacks (i.e., preferably a recess is provided in the area of the tray near the registration wall to reduce or relieve staple build-up, not a raised area).

Further by way of background, outputted sheets are usually ejected into the tray from one end thereof. That is, normal output stacking is by ejecting sheets above one end of the top sheet of a stack of sheets onto which that ejected sheet or sheets must stack. Typically, each ejected sheet travels generally horizontally (or slightly uphill initially) and planarly, primarily by inertia. That is, the sheet is not typically effectively controlled or guided once it is released into the open stacking tray area, and must fall by gravity into the tray to settle onto the top of the stack, which is resisted by the high air resistance of the sheet in that direction. Yet, in a high speed copier or other imager, sheet stacking must be done at high speed. The stacking of sheets is made more difficult where there are variations in thickness, material, weight and condition (such as curls), in the sheets. Different sizes or types of sheets, such as tabbed or cover sheets or inserts, may even be intermixed in the same copy sets in some cases.

The sheet ejection trajectory should also accommodate the varying aerodynamic characteristics of a rapidly moving sheet, which can act as an airfoil to affect the rise or fall of the lead edge of the sheet as it is ejected. This airfoil effect can be strongly affected by fuser or other curls induced in the sheet. Thus, typically, a relatively high restacking ejection upward trajectory angle must be provided. Otherwise, the lead edge of the entering document can catch or snub on the top of the sheet stack already in the restacking tray, and curl over, causing a serious jam condition. However, setting a sufficiently high document trajectory angle to accommodate all these restacking problems greatly increases the sheet settling time for all sheets, as previously noted, and creates other potential problems.

Also, the sheet ejection trajectory must accommodate variations in the pre-existing height of the stack of sheets already in the tray (varying with the set size and sheet thickness) unless a tray elevator is provided to maintain a relatively constant stack height relative to the sheet output ejection position.

Various general problems of sheet restacking, especially the settling of an ejected sheet onto the top of the stack, are well known in the art in general. Some examples of various output restacking assisting devices are taught in Xerox Corporation U.S. Pat. No. 4,469,319; 5,005,821; 5,014,976; 5,014,977; 5,033,731; and art therein. Sheet "knock down" systems are known, but add cost and complexity and can undesirably deflect down prematurely the lead edge of the ejected sheet. Also, such "knock down" systems can interfere with sheet stack removal or loading and can be damaged thereby. Also, stacking systems desirably should not interfere with open operator access to an open output stacking tray or bin.

As to specific hardware components which may be used with the subject apparatus, or alternatives, it will be appreciated that, as is normally the case, various suitable such specific hardware components are known per se in other apparatuses or applications, including the cited references and commercial applications thereof.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well as the claims. Thus, the present invention will be better understood from this description of embodiments thereof, including the drawing figures (approximately to scale) wherein:

Figure 2:
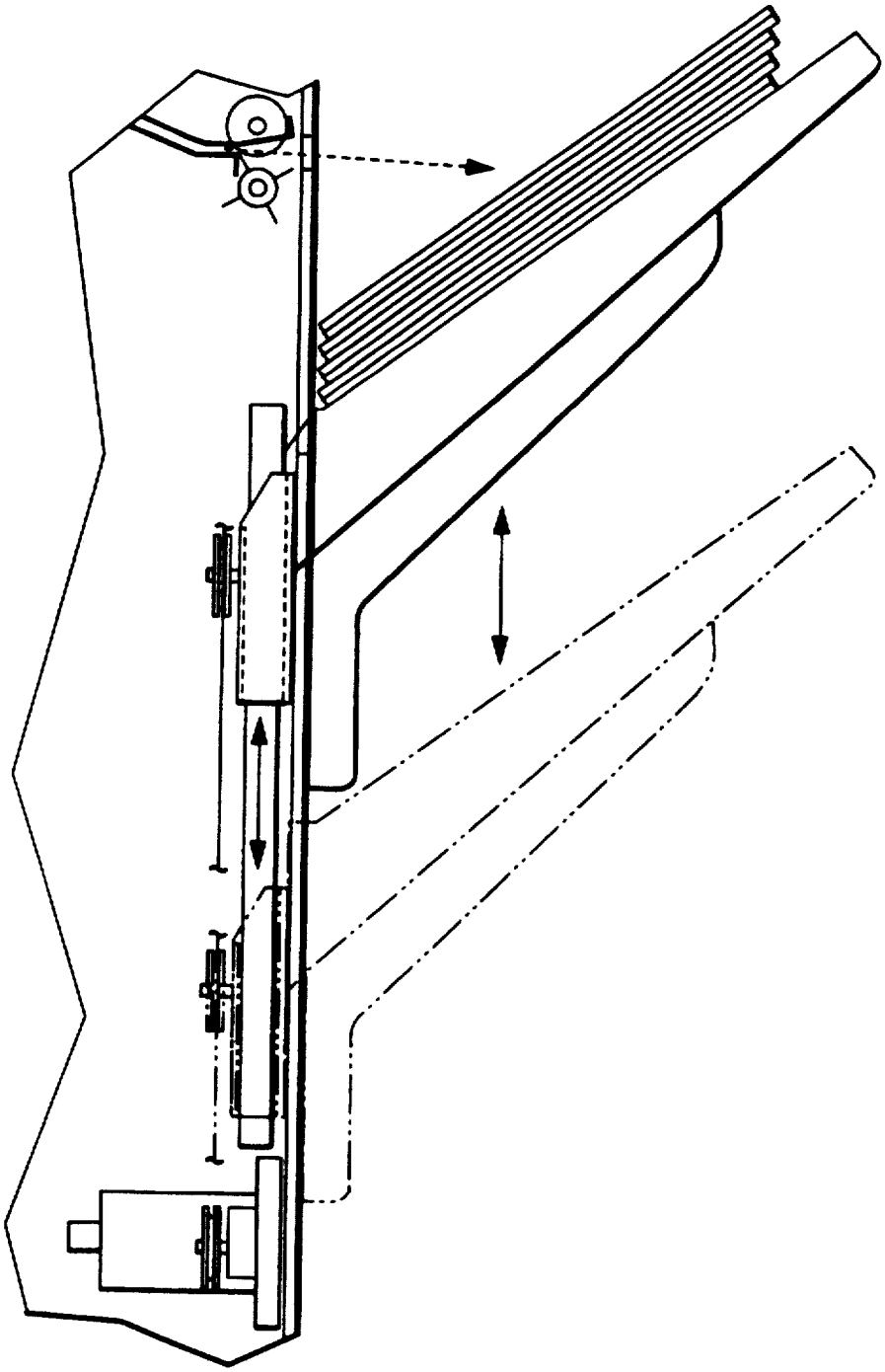
FIG. 2 PRIOR ART
FIG. 2 is an illustrative comparative example of an otherwise similar prior art vertical tray elevator stacking system, labeled, "prior art"
Figure 3:
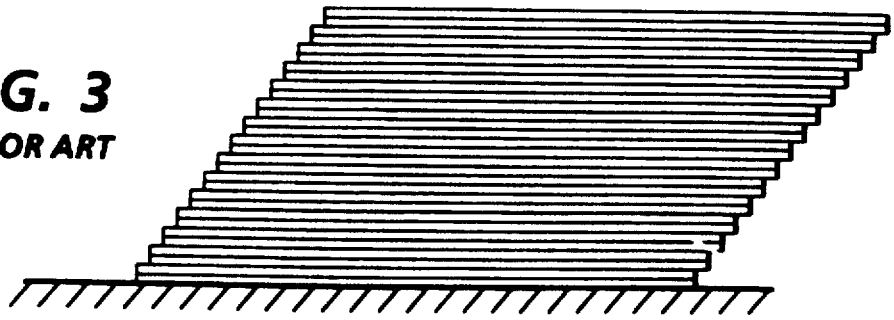
FIG. 3 PRIOR ART
Figure 4:
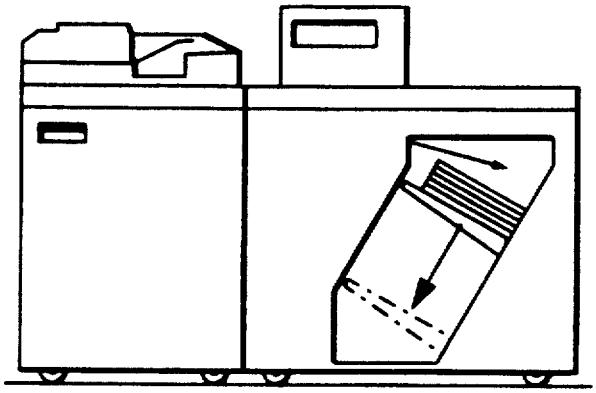
Figure 5:
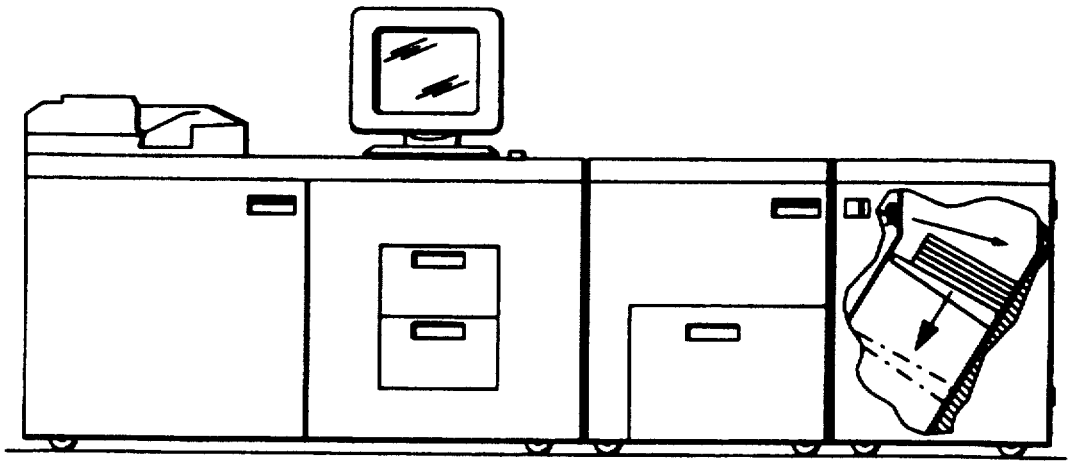
Figure 6:
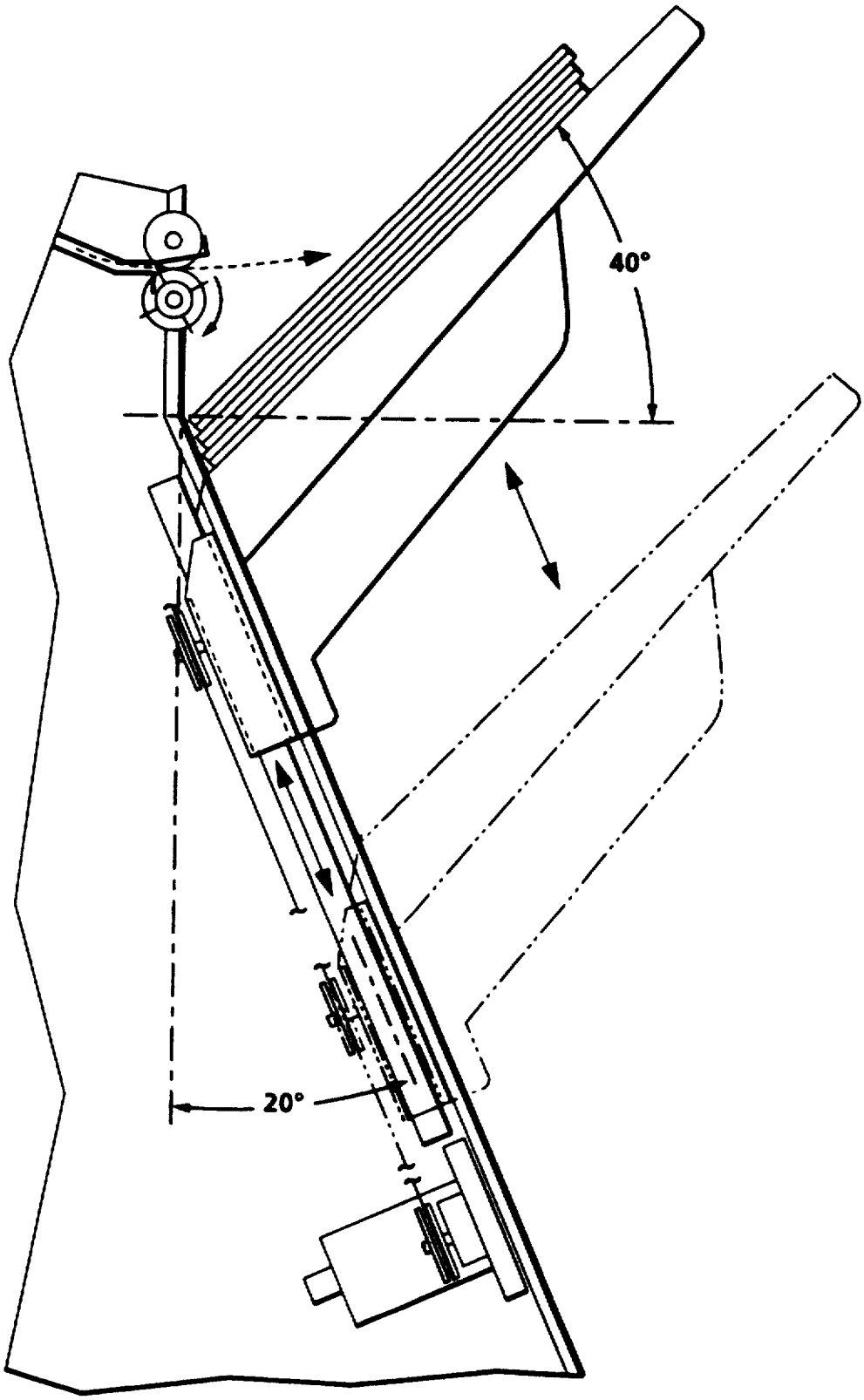

FIG. 3, also labeled prior art, is a simplified view of a stack of copy sheet sets after their removal from the prior art stacking apparatus of FIG. 2 and placement on a normal horizontal surface, for illustration of the problem overcome by the present system;

FIG. 4 schematically illustrates, in a front view, an alternative embodiment with internal "downhill" stacking;

FIG. 5 similarly schematically illustrates a "downhill" stacking docked modular alternative embodiment; and FIG. 6 is a compromise design with only partially squared stacking, with a stacking tray providing an approximately 40 degree angle and a stacking wall of approximately 20 degrees.

Figure 1:
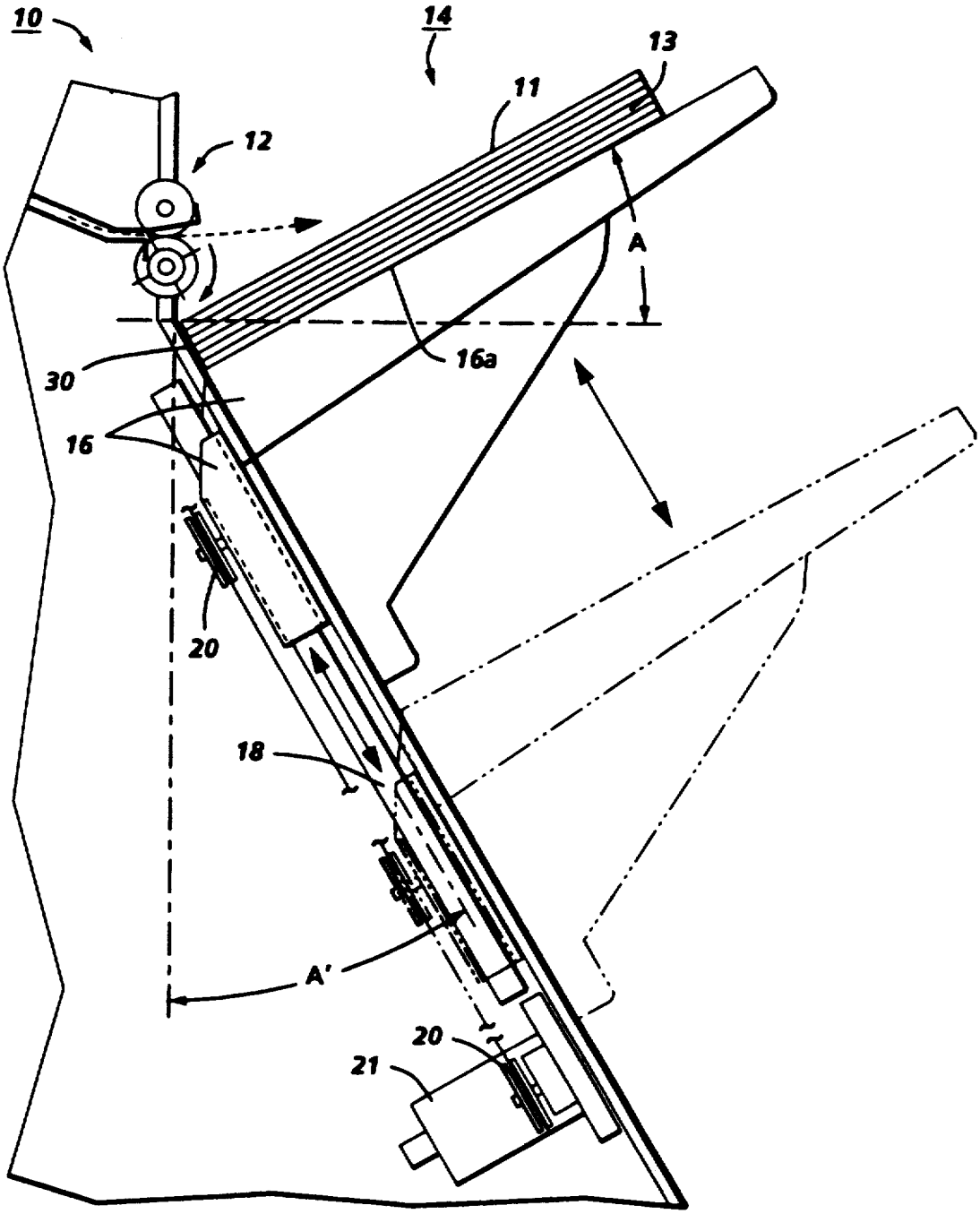
FIG. 1 is a schematic front view of one exemplary copy sheet output system incorporating one example of the present stacking system, showing one exemplary non-vertical tray elevator.

The present invention is not limited to the specific embodiment illustrated herein. Referring particularly to FIG. 1, there is shown one example of a sheet output system 10, at the output 12 of a copier or printer to provide improved output sheet 11 stacking 13 selection and control. This disclosed embodiment transports sheets to a sheet receiving and stacking system 14 for stacking them in a stack 13. That is, there is shown in this output system 10 example a high-capacity elevator type stacking tray or stacker system 14, closely adjacent the output 12 feeding nip, for being fed sheets or sets of sheets for stacking. Although preferably an integral or modular component of a reproduction apparatus, the stacking system 14 may also be a self-contained, standalone unit, wheeled up to and docked with any reproduction apparatus, when desired.

This exemplary stacking system 14 provides an otherwise conventional movable stacking tray unit 16 mounted in a linear, but non-vertical, elevator track 18 to be moved by any suitable elevator system or mechanism 20 to provide a moving floor stacking surface **16*a* for the accumulating stack of sheets in the stacking tray unit 14. The stacking surface 16*a* moves linearly, but non-vertically, maintaining a desired stacking angle of inclination as previously discussed. A conventional tray elevator system 20 controlled by a conventional stack height sensor can be used to maintain the top of the stack at an approximately constant level, and in the same relative position to the output 12, as is well known, and described in the art. This automatic tray unit 16 repositioning as the stack 13 accumulates is illustrated by the associated movement arrow. Various suitable elevator mechanisms are known and/or shown in the art, including the above-cited U.S. Pat. No. 5,026,034, FIG. 2. It may be a cable, ratchet, lead screw, or parallelogram linkage, drive, or other suitable tray elevator mechanism. A known stepper motor drive 21 may be used to move the tray unit 16**. A particularly suitable elevator drive system is already shown and described in the above-cited U.S. Pat. No. 5,098,074 by the same author, in Columns 5–6, inter alia, and need not be described in detail herein.

The specific exemplary embodiment disclosed herein has a stacking tray 16 with an inclined stacking surface **16*a* at a desired stacking angle "A" to the horizontal. The stacking system 14 here also has a sheet stacking registration wall 30 at the lower end of the stacking surface 16*a* which is perpendicular to (at 90° to), the stacking surface. This stacking tray comprises an integral tray unit 16 movably mounted on a tray elevator track 18 and movable by a tray elevator system 20 to maintain the tray angle "A" orientation. The tray elevator system 20 here is uniquely able to move downwardly but also outwardly, in a linear path which is at a minor acute angle "A'" from the vertical. This non-vertical elevator track angle "A'" here is at the same angle as the stacking registration wall 30, which allows the fixed elevator track or, preferably, the fixed end wall 30 of the stacker system 14 or the copier or printer to provide the stacking registration and be perpendicular to the stacking surface 16*a***.

This elevator track angle "A'" is also substantially equal to the angle "A" that the tray surface is inclined from the horizontal to provide "uphill stacking". Thus, desirable initial output stacking and registration of copy sheets is provided a desired angle "A" providing an inclined or sloping surface for edge registration assistance by gravity encouraging the sheets to slide down on top of the inclined stack down against the registration wall 30. Here, that stacking slope is inclined downwardly back towards the sheet output 12, and towards registration wall 30, to provide "uphill stacking."

In the disclosed system, such a desirable initial stacking angle "A" is compatibly combined with correctly, fully aligned, set stacking relative to all previously stacked sets by a compatible non-vertical perpendicular movement along the line of the angle "A'" of the stacking tray for cumulative stacking, and with the registration wall 30 at the same angle "A'". Thus, the registration wall 30 is also perpendicular the stacking surface **16*a***. All sheets of the completed or removed stack may be evenly aligned and superposed with one another with the present system.

As an optional feature, if there is no tray elevator stack height sensor control, the control logic in a conventional controller can be used with a tray switch to count the total number of outputted sheets since the tray was last emptied to provide an approximate determination of the stack 13 height, and provide corresponding control signals in response thereto. These may be fed here to the control for the stepper motor drive 20 to effect a corresponding change in tray height.

Additionally, an integral or related copy set stapler of or other finisher can be provided prior to stacking, as disclosed in said U.S. Pat. No. 5,098,074, issued Mar. 24, 1992 by Barry P. Mandel, et al., for example.

Although copy sheet output stacking is described herein, it will be appreciated that there may be extended applications for the present concept, such as for use for a document "job batching" restacker for accumulating original documents and restacking them after sequential document copying or scanning jobs have been completed.

Although a desired "uphill" stacking system is primarily illustrated herein, with registration at the inside of the stacking system, as optionally shown in FIGS. 4 and 5, the concept here could be extended to a copier or printer output system with a "downhill" (or even horizontal) set registering compiler/finisher or the like, ejecting sheets or sets of sheets into a downhill stacker with an outside instead of an inside registration end wall. As shown in FIG. 4, this could be provided with stacking in an opening internal the reproduction machine rather than at one end, and with an opposing inclined wall parallel the inclined elevator track wall. Or, downhill stacking can be provided in an end module facing into the processor, docked therewith as shown by the parting lines in FIG. 5. A door-covered module is shown there with the door shown partially broken away for illustration. In these cases, the elevator track and the registration wall would extend at the opposite angle from the vertical, i.e., inclining towards the machine output as the stacking tray lowers, rather than moving away from the machine as it lowers, as in the prior illustrated embodiment, i.e., at approximately the same angle from the vertical, but opposite thereto.

The present system provides a solution to the problem of large, heavy, completed stacks of sets of sheets being so offset in the same direction that they are hard for the operator to handle, may slip and cannot be realigned easily by edge tamping or the like, because of the total stack weight, thickness and/or staples interfering with stack realignment. As noted, such a misaligned stack cannot be easily stacked into a normal sized box or carrying container and can even fall over when taken out of the stacker by the operator and placed on a normal horizontal surface.

In the system shown herein, the output stacking elevator recedes in a non-vertical direction at angle "A'" as shown in FIG. 1. Because of this, the resulting stack accumulating thereon can be made perfectly square, as shown in FIG. 1, if desired.

Although not relevant to the disclosed system, it is noted that, conventionally, when a compiler/stapler station is utilized, a side tamper may be provided to tamp each set into the corner compiling for corner stapling with the stapler unit, and then the stapled set may be offset before the ejection of the stapled set into the stacker tray.

The concept herein could also be utilized even in a compiler or single tray finisher stapling system with relatively small sets of copy sheets being stacked in order to enable steeper compiling angles without skewing of the set to be stapled. Here also, the stack of accumulated copy sheets remains square while it is accumulated on the tray, because the registration wall remains perpendicular to the stacking tray surface.

Alternatively, as shown in one example in FIG. 6, the compiler and/or stacking angle "A" may be made larger (and larger than "A'") to provide a steeper slope on the top of the stack during stacking, without increasing the resultant stack skew beyond permissible levels. That is, in some situations, it may be desirable to compromise and allow a small degree of stack skew in the ultimate stack, by a tray angle not fully perpendicular its movement direction, in order to enable compiling at an even steeper angle, particularly for a single tray finisher system. In FIG. 6, the angle A is about 40 degrees and the angle A' is about 20 degrees. Even in this type of compromise system, for example, 1000 sheets can be stacked with approximately the same stack skew or lean as would be generated in a 500 sheet stack using a 35° tray angle and a conventional vertically receding elevator. This reduces both machine footprint and upcurled sheets "climbing" the registration wall as the stack is lowered.

As shown in FIG. 1, preferably the sheet ejection rollers extend out slightly over (beyond, or downstream of) the registration wall 30. The lower exit rollers shaft may also desirably include known flexible sheet flappers, as shown. This helps control upcurled sheets in uphill stacking. The elevator system is preferably also controlled to keep the top of the stack close to or against the lower sheet ejection rollers to help keep the stacked sheets pressed down and preventing them from "climbing" up the registration wall 30, especially if a fully square registration wall is provided at 90 degrees to the stacking tray angle.

The present system may be desirably combined with an orbiting nip (or other) optional sheet output inverter plural mode output, etc., as shown for example in two contemporaneously filed, copending, commonly assigned, applications, U.S. application Ser. No. 07/903,291, now U.S. Pat. No. 5,201,517 by Denis Stemmle, entitled "Orbiting Nip Compiler for Faceup or Facedown Stacking" and, U.S. application Ser. No. 07/903,298 by Denis Stemmle, et al., entitled: "Orbiting Nip Sheet Output with Faceup or Facedown Stacking and Integral Gate."

While the embodiment disclosed herein is preferred, it will be appreciated from this teaching that various alternatives, modifications, variations or improvements therein may be made by those skilled in the art, which are intended to be encompassed by the following claims:

What is claimed is:

1. A sheet stacking apparatus for stacking precollated copy sheets integral a precollating reproduction machine;

said reproduction machine having an integral non-vertical end wall with a copy sheet output integral said end wall for outputting said precollated copy sheets;

an output copy sheet stacking tray integral said non-vertical end wall providing a sheet stacking surface inclined at a substantial angle to the horizontal upwardly away from said integral machine integral non-vertical end wall for receiving said sheets to be stacked on said tray from said sheet output of said machine;

wherein said integral machine non-vertical end wall is non-vertically inclined downwardly away from said machine at an angle which is substantially perpendicular to said angle of said inclined sheet stacking surface of said sheet stacking tray;

said integral machine non-vertical inclined end wall forming a substantially continuously planar rear sheet edge registration surface against which the rear edges of said sheets being stacked are registered by sliding down said inclined sheet stacking surface of said tray to abut against said integral machine non-vertical end wall;

an elevator for linearly repositioning said sheet stacking tray relative to said sheet output of said machine without changing said inclination so as to accommodate the stacking of multiple said copy sheets on said inclined sheet stacking surface without interfering with further stacking of said sheets from said sheet output;

said elevator being inside said machine behind said integral machine non-vertical end wall;

said elevator linearly repositioning said sheet stacking tray parallel to said integral machine non-vertical end wall to continuously provide non-vertical but substantially squarely superposed said sheet stacking on said inclined sheet stacking surface against said integral machine non-vertical end wall irrespective of said repositioning of said stacking tray by said elevator.

* * * * *